United States Patent [19]

Ollivier et al.

[11] 4,074,842

[45] Feb. 21, 1978

[54] DEVICE FOR INSERTING NAIL-LIKE FASTENERS AT DIFFICULTLY ACCESSIBLE POINTS

[76] Inventors: Jean Ollivier, 89 avenue des Beaumes; Marc Combette, 116 rue des Moulins, both of Valence, France, 26000

[21] Appl. No.: 749,580

[22] Filed: Dec. 10, 1976

[30] Foreign Application Priority Data

Dec. 9, 1975 France ..... 75 37630

[51] Int. Cl.[2] ..... B25C 1/14

[52] U.S. Cl. ..... 227/8; 227/10

[58] Field of Search ..... 227/8, 9, 10

[56] References Cited

U.S. PATENT DOCUMENTS

| | | | |
|---|---|---|---|
| 3,482,753 | 12/1969 | Bayer et al. | 227/10 |
| 3,643,850 | 2/1972 | Endo et al. | 227/8 |
| 3,929,269 | 12/1975 | Hodil | 227/10 |

*Primary Examiner*—Granville Y. Custer, Jr.

*Attorney, Agent, or Firm*—William W. Jones; Paul J. Lerner

[57] ABSTRACT

A power-actuated tool for fastening insulation plates to ingot mold surfaces. The tool includes a cocking foot which reciprocates with respect to the tool breech. Reciprocation of the cocking foot cocks the firing pin and opens and closes an ammunition loading window. A double sear is provided so that the tool cannot be air-fired.

5 Claims, 6 Drawing Figures

DEVICE FOR INSERTING NAIL-LIKE FASTENERS AT DIFFICULTLY ACCESSIBLE POINTS

The present invention relates to a device for inserting nail-like fasteners at difficultly accessible points, the device being of the type comprising a barrel arranged for receiving a fastener in its forward end, a piston ram axially displaceable within the barrel, and an extension member, integral with the barrel, with its axis perpendicular to the barrel axis and a firing handle secured at the end of the extension member.

Devices of this type are particularly used for securing exothermic plates on molds such as ingot molds having a small inside width, whereby the plates are operative for retarding the cooling of the molten steel in the upper portion of the mold.

The presently used devices are of complex construction as regards the loading mechanism as well as the cocking and firing mechansim. These mechanisms use a plurality of variously shaped levers for the transmission of movements from the firing handle located at the end of the extension member.

The primary object of the present invention is a device of the type described above in which the loading and cocking are effected by very simple means. The device, according to the invention, comprises a breech in operative connection with said extension member and having an ammunition recess whose access can be closed by a sleeve coaxial with said extension member, whereby the device is provided with a lateral window facing the ammunition recess. There is an external operating member in operative connection with the sleeve and displaceable for displacing the latter against a biasing means. A firing pin holder is mounted for displacement in the axial direction of the sleeve and resiliently biased in abutment against the latter, and retractable means are provided for maintaining the firing pin holder in a position such that the firing pin is retracted from the ammunition recess, which position is called the cocked position.

In actuating the operating member, the sleeve is displaced to leave the ammunition recess accessible through the access window and ready for loading. Moreover, this displacement brings about the displacement of the firing pin holder, because the latter bears against the sleeve.

At the end of a certain travel, the retractable means engage with the firing pin holder and, to some extent, delay the sleeve action. The firing pin holder is thus in the cocked position. Once loading has taken place, the operating member can be released and the resiliently biased sleeve moves back into the closure position. The ammunition recess is then closed and also the sleeve will not prevent the displacement of the firing pin holder for the purpose of firing.

According to a preferred embodiment, the operating member is a U-shaped yoke, secured by its sides to the sleeve and extending outwardly on the device in a direction diametrically opposed to the extension member. In order to displace the sleeve for cocking purposes, it is consequently merely necessary to position the device on a horizontal support, for example, the ground. Due to the action of its weight, the device reciprocates the U-shaped yoke, this relative displacement forcing the sleeve, connected to the yoke, to move with the yoke.

In an extremely simple manner, this brings about the cocking and frees the access to the ammunition recess.

To maintain the firing pin holder in the cocked position, a pivoting lever is resiliently biased for engagement of one of its ends with the firing pin holder and is retractable under the action of a remote control member. The remote control member can, for example, be a flexible cable, controlled from a firing handle secured at the end of the extension member. Thus, the arrangement according to the invention eliminates the firing or percussion bars which are used in known devices and which extend over the entire length of the extension member and thus necessitating complicated biasing and control members.

Safety regulations concerning fastener-driving tools preclude any possibility of air firing of the tools. To this end a second pivoting lever is resiliently biased for engagement of one of its ends with the firing pin holder and retractable under the action of a tubular member displaceable coaxially with the barrel and extending outwardly from the muzzle end of the barrel.

Thus, when the device is not pressed against a wall, the device cannot be fired because the second lever cannot pivot, so that the firing pin holder remains in the cocked position. However, when the device is pressed against a wall, the tubular member moves back thus pushing back the second lever against the force of the biasing means. Thus the device can be fired by action on the cable, which brings about the retracting of the first lever and which can take place either after or before the pressing of the device against a wall.

The invention will be better understood from reading the following description, with reference to the attached drawings, in which.

Figure 1:
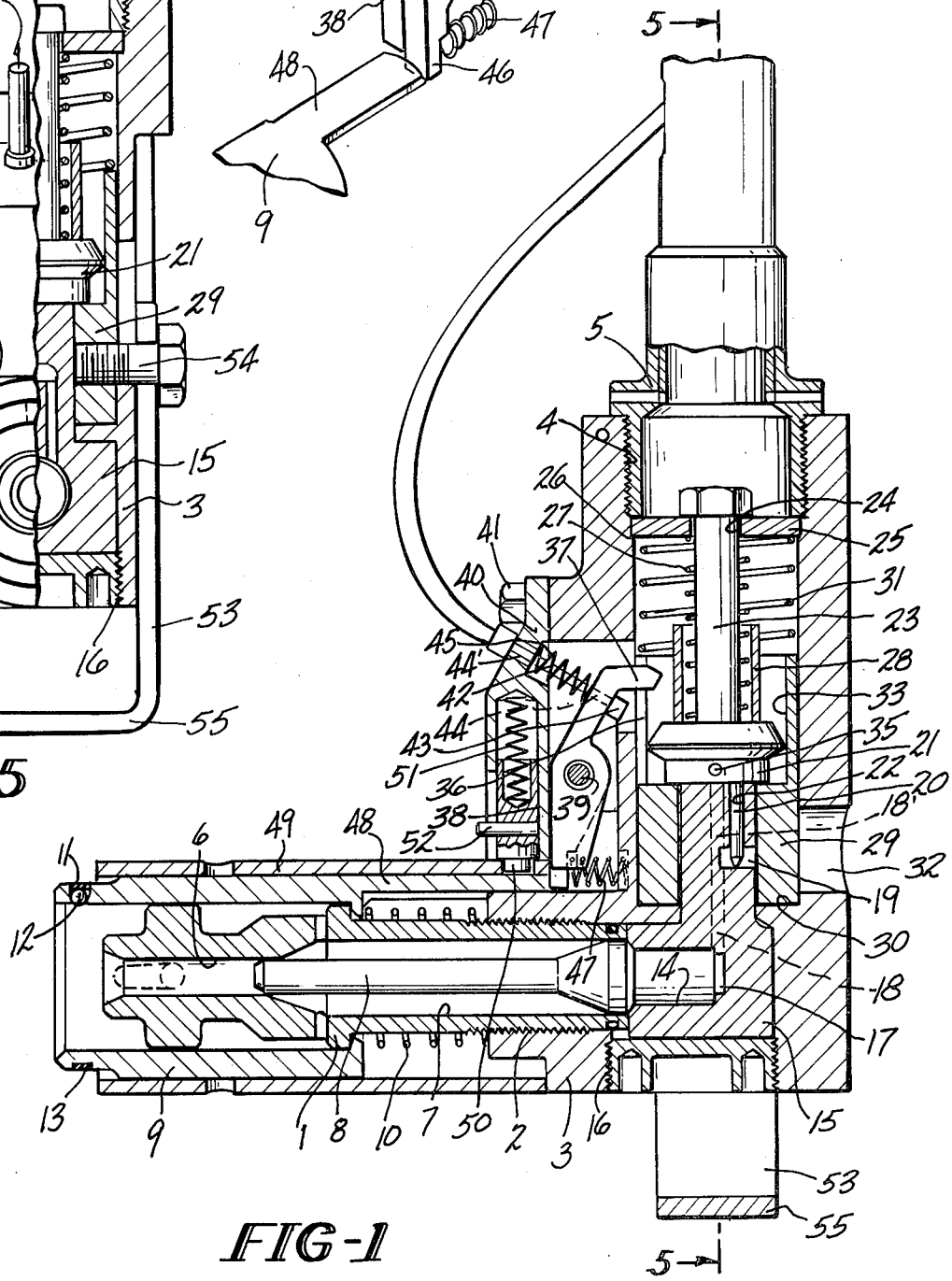
FIG. 1 is a longitudinal sectional view of the device, according to the invention, in the inoperative position.

The tool according to the invention shown in FIG. 1 comprises a barrel 1 screwed by a thread 2 to an approximately parallelepiped-shaped casing 3. The casing 3 is itself screwed by a thread 4 to an extension member 5, only a portion of which is shown, and to the end of which, opposite to casing 3, a firing handle (not shown) is secured.

Figure 4:
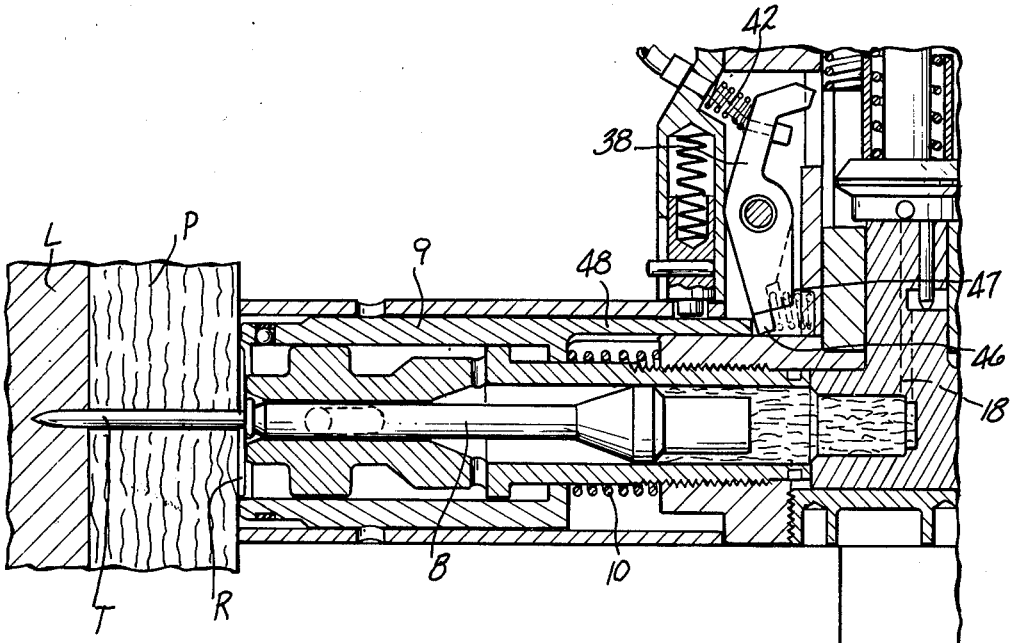
FIG. 4 is similar to FIG. 1, but showing the device just after firing.

The bore of barrel 1 has a forward portion 6 arranged for receiving a fastener T, used for securing a plate P on the wall L of an ingot mold (see FIG. 4) and a rearward portion 7, wherein a piston ram 8 is slidingly mounted. A tubular member 9, coaxial with barrel 1 and biased by a compression spring 10 is slidingly mounted on barrel 1. Tubular member 9 has openings 11, adjacent to its forward end, wherein balls 12 are retained retractable and held in place by an O-ring 13. The balls 12 secure a washer R within tubular member 9 which washer is associated with fastener T for fixing the plate P.

The rearward portion of piston ram 8 is in operative engagement with a blind hole 14 provided in a breech 15, locked within casing 3 by a threaded cap 16. At the end of blind hole 14, breech 15 has a chamber 17 connected by a passage 18 to a radial slot 19 provided on the periphery of the breech and which serves to receive an ammunition charge M (see FIG. 2), shown in disk shape in the drawing.

Figure 2:
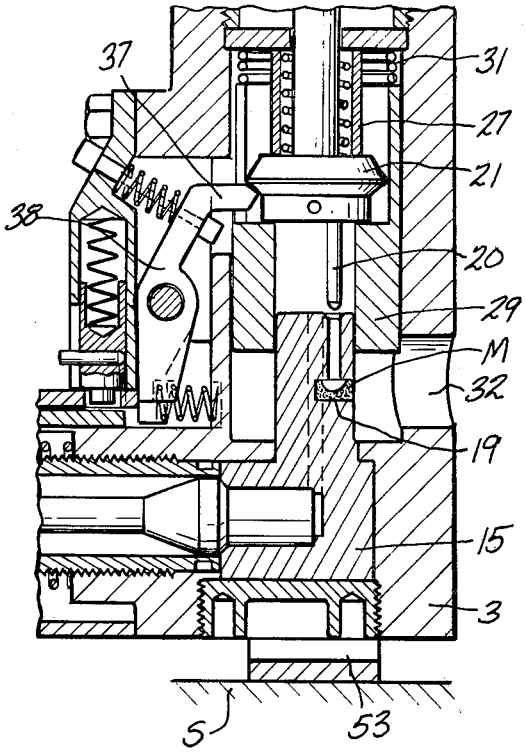
FIG. 2 is a view of a portion of the device shown in FIG. 1, at the time of cocking.

For the firing operation, the device has a firing pin 20 secured to a firing pin holder 21 whereby the firing pin 20 is received in a passage 22 provided in breech 15. The firing pin holder 21 has a rod 23 which can slide in an opening 24 located in a thrust-plate 25 locked between a shoulder 26 of the casing 3 and the end of extension member 5. The firing pin holder 21 is biased in the direction of breech 15 by a compression spring 27 bearing against thrust-plate 25, and is provided with a spacer 28 which serves to bear against plate 25 at the time of cocking, as can be seen in FIG. 2.

In its portion containing the ammunition recess 19, breech 15 is cylindrical and coaxial with extension member 5. In this area, it is surrounded by a sleeve 29, which, in the position shown in FIG. 1, bears against a shoulder 30 of casing 3 and completely closes the access to the ammunition recess 19. Sleeve 29 is slidingly mounted on the cylindrical portion of breech 15 and is biased by a compression spring 31 against shoulder 30. Spring 31 bears against thrust-plate 25. Moreover, an access window 32 is provided in the wall of casing 3 facing the ammunition recess 19 and permits access to the latter when, as can be seen in FIG. 2, sleeve 29 has moved against its biasing spring 31.

The upper portion of sleeve 29 has a large diameter bore 33, which ensures the sliding guidance of the firing pin holder 21. Moreover, the inner periphery of sleeve 29 has a groove 34, shown in FIG. 3, which co-operates with a lug 35 formed on the firing pin holder 21 for improving guidance.

Figure 6:
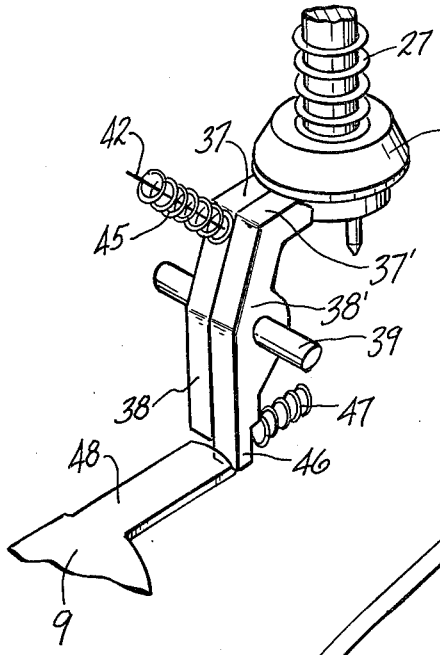
FIG. 6 is an exploded perspective view of the firing control members.

Sleeve 29 has an inlet opening 36 permitting the passage of arm 37 of lever 38 and arm 37' of lever 38', shown in FIG. 6. Levers 38 and 38' are sears which are pivotally mounted on a pin 39, connected to the casing 3. Levers 38 and 38' can pivot independently of one another. By their front faces, levers 38 and 38' bear against plate 40 secured to the casing by screws 41.

The pivotal movement of lever 38 is controlled by a flexible cable 42, having a hold-down head 43 bearing against the rear face of lever 38. Openings 44 and 44' are respectively provided in lever 38 and plate 40 for the passage of flexible cable 42, which is connected to a firing handle (not shown), secured at the end of extension member 5. A biasing spring 45 resists accidental pulling on flexible cable 42.

The lower end of lever 38' has an extension part 46, which can best be seen in FIG. 6, which forms a supporting surface for a compression spring 47 which is also bearing against casing 3. Moreover, the opposite face of extension member 46 serves as an abutment for the rearward end 48, in the form of a tongue, of tubular member 9, slidingly mounted on barrel 1.

A sleeve 49, coaxial with barrel 1 and tubular member 9, bears against casing 3 and is maintained in position by a rod 50 mounted within plate 40 and biased by spring 51. A pin 52 is provided to displace from engagement the end of rod 50 during the disassembly of the device.

Figure 5:
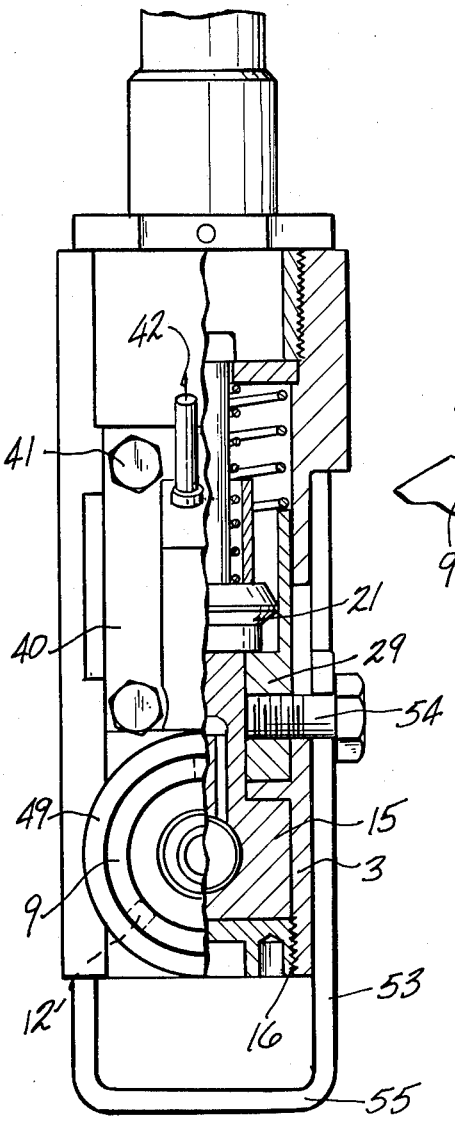
FIG. 5 is a view, partly in end elevation and partly in section along the line V—V in FIG. 1.

Moreover, a U-shaped yoke 53, best seen in FIG. 5, is secured to sleeve 29 by screws 54, with its base 55, parallel to the base of casing 3 and to the axis of barrel 1, being spaced from casing 3 in such a way that a relative movement is possible between, on the one hand, U-yoke 53, and therefore sleeve 29, and on the other, the remainder of the device.

The device operates in the following manner. Prior to cocking and firing, the device is in the position shown to FIG. 1. Sleeve 29 is in the low position so that the firing pin holder 21 rests on the upper face of breech 15 and on the base of the large diameter bore of sleeve 29. Furthermore, the ammunition recess 19 is closed by sleeve 29. At this stage, a fastener T can be introduced in the forward end of the barrel.

Then, for the cocking and loading operations, the device is placed on a horizontal support S, in the manner shown in FIG. 2. Under the action of its own weight or by the operator pushing down, the device is pushed down on U-shaped yoke 53, which brings about the raising of sleeve 29, which is connected to the yoke 53, against the force of the biasing spring 31. The sleeve 29 moves the firing pin holder 21 during its displacement. During its raising movement, the firing pin holder 21 pivots the arms 37 and 37' of levers 38 and 38'. Then, levers 38 and 38' respectively biased by springs 45 and 47 return to their initial position, while preventing the firing pin holder 21 from being lowered again under the action of spring 27. In this way, the device has been cocked.

Moreover, the raising of sleeve 29 has freed access to the ammunition recess 19, permitting the introduction of an ammunition M into the recess through access window 32.

Figure 3:
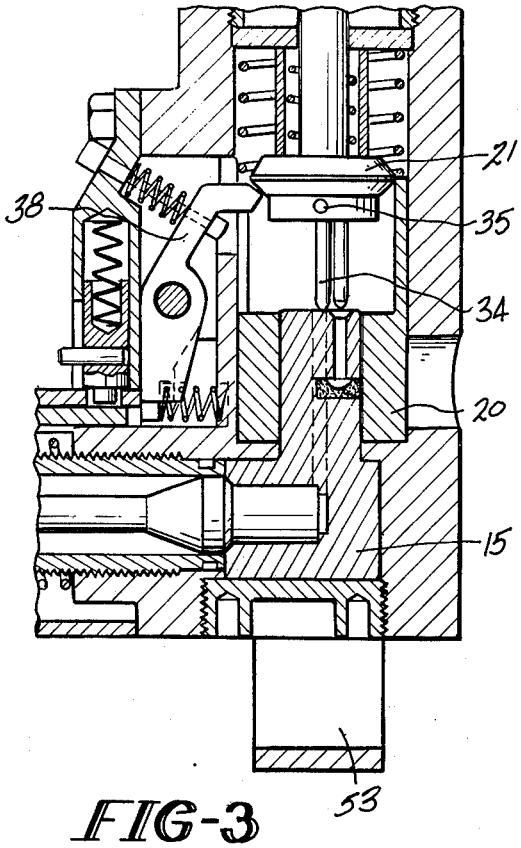
FIG. 3 is similar to FIG. 2, but showing the device after cocking and loading.

The pressure on U-shaped yoke 53 is then released to return the latter to the position shown in FIG. 3. As will be noted, the sleeve 29 is lowered again and closes the ammunition recess 19. The device is then ready for firing.

Two operations are necessary for firing. First, the front of the device must be pressed onto plate P in such a way as to rearwardly slide tubular member 9 whereby the thrust of tongue 48 on extension member 46 brings about the retracting of lever 38' against the force of spring 47. Furthermore, a pulling action must be exerted on flexible cable 42 from the firing handle in order to bring about the retracting of lever 38.

These two operations can be performed in any sequence, but both are necessary because the firing pin holder 21 will be maintained in the cocked position if either one of the levers 38 or 38' has not pivoted. Thus, firing can only take place when the device is bearing on a working surface.

The actual firing is performed in conventional manner and requires no supplementary explanation. The position of FIG. 1 is thus assumed.

Since many changes and variations of the disclosed embodiment of the invention may be made without departing from the inventive concept, it is not intended to limit the invention otherwise than as required by the appended claims.

What is claimed is:

1. A power-actuated fastener-driving tool comprising:

(a) a barrel assembly having a muzzle end adapted to receive a fastener to be driven into a supporting surface;

(b) a casing member connected to said barrel assembly;

(c) firing pin means mounted in said casing member for percussive firing of a power charge chambered in the tool, said firing pin means being movable between a cocked position and a fired position;

(d) first spring means engaging said firing pin means to bias the latter toward said fired position;

(e) an elongated extension member connected to said casing member and extending in a direction substantially perpendicular to the axis of said barrel member to facilitate positioning of the tool in difficultly accessible places;

(f) an operating member mounted on said casing member and projecting externally therefrom in a direction diametrically opposite from said extension member, said operating member being reciprocably movable, with respect to said casing member, through a cocking stroke and return upon successive application and release of pressure to a free end of said operating member;

(g) second spring means operably connected to said operating member for biasing the latter through said return stroke;

(h) said operating member being operably connected to said firing pin means for causing movement of the latter to said cocked position upon movement of said operating member through said cocking stroke;

(i) first sear means releasably engaging said firing pin means to hold the latter in said cocked position; and (j) actuating means connected to said first sear means and mounted on said extension member for manual operation thereof, whereupon said actuating means is operable to disengage said first sear means from said firing pin means.

2. The tool of claim 1, further comprising second sear means for releasably engaging said firing pin means to hold the latter in said cocked position; and a release member slidably mounted with respect to said casing member, said release member extending from said casing member to the tool muzzle and having one end part for contacting the supporting surface and an opposite end part for contacting said second sear means to form sear-releasing means operative to cause said second sear means to disengage from said firing pin means when the tool is pressed against a work surface so as to cause sliding movement of said release member toward said casing member to occur.

3. The tool of claim 2, wherein said first and second sear means are both pivotally mounted on a common pin secured to said casing member.

4. The tool of claim 1, further comprising an access window through said casing member to permit chambering and ejection of a power charge in the tool; and a sleeve slidably mounted in said casing for selectively closing off said access window against passage of a power charge therethrough, said sleeve being operably connected to said operating member to open said window when said operating member is moved through said cocking stroke.

5. The tool of claim 4, wherein said sleeve has a bore in which said firing pin means is mounted and which serves to guide movement of said firing pin means.

* * * * *